US007228088B2

(12) United States Patent
Shimmura

(10) Patent No.: US 7,228,088 B2
(45) Date of Patent: Jun. 5, 2007

(54) COLOR IMAGE FORMING APPARATUS AND COLOR IMAGE FORMING METHOD

(75) Inventor: Shoko Shimmura, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 38 days.

(21) Appl. No.: 11/038,178

(22) Filed: Jan. 21, 2005

(65) Prior Publication Data

US 2006/0165432 A1 Jul. 27, 2006

(51) Int. Cl.
*G03G 15/16* (2006.01)

(52) U.S. Cl. ..... 399/101; 399/149; 399/150; 399/199; 399/302; 399/308

(58) Field of Classification Search ..... 399/101, 399/149, 150, 298, 299, 300, 302, 308, 231
See application file for complete search history.

(56) References Cited

U.S. PATENT DOCUMENTS

| | | | | |
|---|---|---|---|---|
| 4,727,395 | A | 2/1988 | Oda et al. | |
| 6,337,967 | B1 | 1/2002 | Izumi et al. | |
| 2003/0129006 | A1 | 7/2003 | Hoshi et al. | |
| 2004/0131395 | A1* | 7/2004 | Ishida | 399/298 |
| 2004/0228656 | A1* | 11/2004 | Kamimura | 399/149 |

FOREIGN PATENT DOCUMENTS

| | | | |
|---|---|---|---|
| JP | 3-214174 A | | 9/1991 |
| JP | 05341617 A | * | 12/1993 |
| JP | 07244414 A | * | 9/1995 |
| JP | 9-120190 A | | 5/1997 |
| JP | 10055094 A | * | 2/1998 |
| JP | 2001-75331 A | | 3/2001 |
| JP | 2001-92214 A | | 4/2001 |
| JP | 2002182447 A | * | 6/2002 |
| JP | 2003149899 A | * | 5/2003 |
| JP | 2003-186281 A | | 7/2003 |
| JP | 2004-205944 A | | 7/2004 |

OTHER PUBLICATIONS

U.S. Appl. No. 10/944,011, filed Sep. 20, 2004, Shimmura.

* cited by examiner

*Primary Examiner*—David M. Gray
*Assistant Examiner*—Laura K Roth
(74) *Attorney, Agent, or Firm*—Foley & Lardner LLP

(57) ABSTRACT

In an image forming apparatus of the present invention capable of forming a full-color image by superposing a black toner image formed by a black image forming unit using a developing and simultaneous cleaning type developing unit over color toner images obtained by color image forming units using developing and simultaneous cleaning developing units arranged in tandem, adhered toners generated from the black image forming unit or the color image forming units to be recovered are all recovered by a same single cleaner.

10 Claims, 4 Drawing Sheets

COLOR IMAGE FORMING APPARATUS AND COLOR IMAGE FORMING METHOD

BACKGROUND OF THE INVENTION

1. Field of the Invention

The present invention relates to a color image forming apparatus and a color image forming method to obtain a color image by superposing a number of plural color images formed using plural image carriers with an electro-photographic copying machine, a printer, etc.

2. Description of the Related Art

For a color image forming apparatus such as copying machine, printer, etc., it is demanded to speed up image forming time, get color image of good color reproduction, prevent deterioration of various consumables for color image forming when forming monochromatic images, and decrease scattering toners generated when transferring images. In the Japanese Patent Application Publication No. 2003-186281 or 2004-205944, an image forming apparatus capable of forming color images on recording paper using color image forming units provided with plural color photosensitive drums arranged in tandem and forming monochromatic images on recording paper without driving color image forming units by a black image forming unit provided separately from color image forming units to form a black toner image on a black photosensitive drum are disclosed. In either of these conventional image forming apparatus, the black image forming unit only is used for forming monochromatic images with sharp image quality without using various consumables for the color image forming unnecessarily to prevent deterioration of consumables and decrease scattering of toners. Further, when forming color images, color images of good color reproducibility are obtained according to the intermediate transfer system.

On the other hand, for a color image forming apparatus which consumes much toner, use of recycled toners for saving toners is demanded in recent years. In the Japanese Patent Application Publication No. 248047, an image forming apparatus which recovers toner remaining on photosensitive drums after completing the transfer in the next image forming and developing process in the developing units at the same time of the development is disclosed. When such developing units for cleaning remaining toner at the same time of the development are used, it is not necessary to arrange cleaners around photosensitive drums and an apparatus in smaller size can be achieved, abrasion of photosensitive drums by cleaners is prevented extending the life of the apparatus and at the same time, consumption of toner can be saved by recycling recovered toner.

However, even when developing units which clean residual toner at the same time of the development were used, toner adhered on, for example, the transfer belt which conveys recording paper were recovered by a cleaner of the transfer belt in the past. On the other hand, when the intermediate transfer system is used to transfer color toner images on the intermediate transfer medium on a recording paper in lump after superposing them on the intermediate transfer belt in order to improve the color reproducibility in the color image forming, toner adhered on the intermediate transfer belt are recovered by an intermediate transfer belt cleaner. Furthermore, each cleaner must perform the recycle process or disposing process of the recovered toner, and the toner recovery becomes complicated and impedes the effective toner recycling use.

Therefore, in a color image forming apparatus suited to both the color image forming and the monochromatic image forming, a color image forming apparatus and a color image forming method capable of easily recovering and accelerating the recycle use of adhered toner generated from color image forming units or a black image forming unit, and further improving the efficiency of toner consumption and a color image forming method are desired.

SUMMARY OF THE INVENTION

An object of the present invention is to recover adhered toner generated from color image forming units and a black image forming unit easily without deteriorating various consumable goods and effectively use recovered toners by recycling, extend life-times of various consumable goods and promote efficiency of toner consumption in a color image forming apparatus provided with color image forming units and a black image forming unit.

According to the embodiments of the present invention, the color image forming apparatus to form color images including a first color toner images and a second color toner image differing from the first color is characterized in that it is equipped with a first image forming means provided with developing means to perform the development and simultaneous cleaning of electrostatic latent image formed on a first image carrier for forming the first color toner image and a second image forming means provided with a developing means to perform the development and simultaneous cleaning of electrostatic latent image formed on a second image carrier to form the second color toner image, a first transferring means to transfer toner images on the first image carriers and a second transferring means to transfer a toner image on the second image carrier, and a single cleaning means to recover toners adhered on the first and second transferring means.

DETAILED DESCRIPTION OF THE EMBODIMENTS

Figure 1:
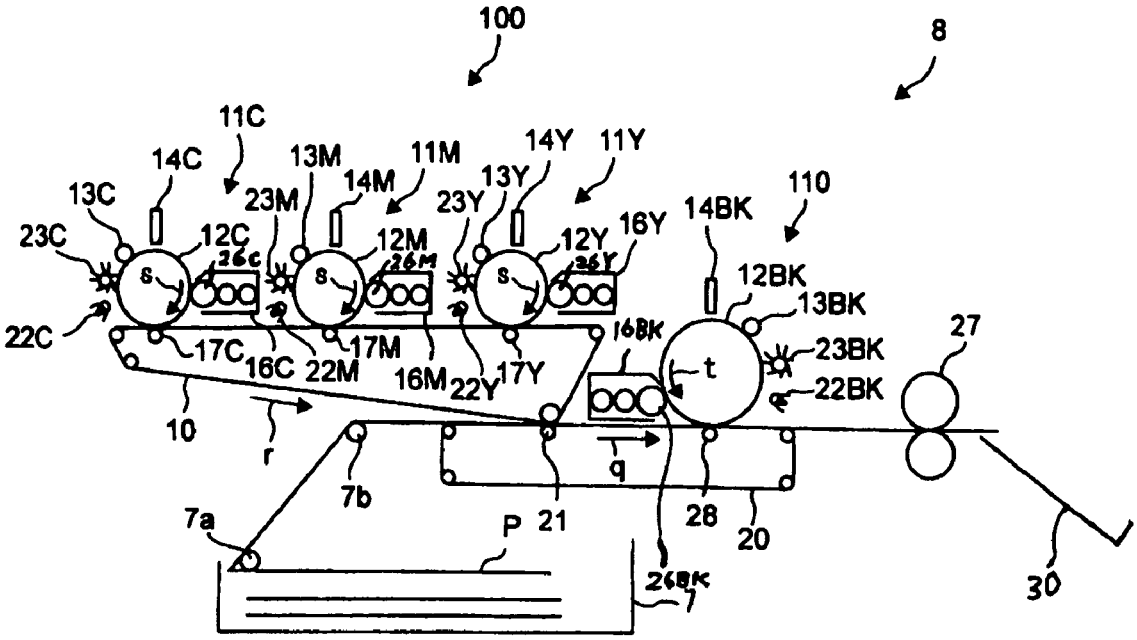
FIG. 1 is a schematic construction diagram showing a printer in a first embodiment of this invention.

The first embodiment of this invention will be described below in detail referring to the attached drawings. FIG. 1 is a schematic construction diagram showing a printer 8 that is a color image forming apparatus in the first embodiment of this invention. Printer 8 is provided with a pick-up roller 7*a* to take out a sheet paper P that is a recording medium housed in a paper supply cassette 7 and an aligning roller 7*b* to supply a sheet paper in the direction of a transfer belt 20 that is a first conveying means provided to a first transfer means after keeping sheet paper P in the standby state. Further, transfer belt 20 conveys supplied sheet paper P in the direction of transfer position. A color image forming unit 100 that is a second image forming means to transfer and form second color toner images of yellow (Y), magenta (M) and cyan (C) and a black image forming unit 110 that is a first image forming means to transfer and form a monochromatic toner image; a black (BK) first color toner image are arranged along transfer belt 20 rotating in the direction of allow q.

Color image forming unit 100 has an intermediate transfer belt 10 that is a second transfer means provided to the second transfer means and yellow (Y), magenta (M) and cyan (C) sub-units 11Y, 11M and 11C arranged in tandem from the upper stream side in the rotating direction along a intermediate transfer belt 10 that is rotated in the direction of arrow r. Middle transfer belt 10 is manufactured with polyimide of volume resistance $1\times10^{9}\Omega$. Middle transfer belt 10 transfers color toner images formed on photosensitive drums for color images 12Y, 12M and 12C, which are second image carriers of sub-units 11Y, 11M and 11C on a sheet paper P on transfer belt 20 at the secondary transfer position secondarily after the color toner images were first transferred.

+300V primary transfer bias is applied to the primary transfer position of intermediate transfer belt 10 by primary transfer rollers 17Y, 17M and 17C composed of conductive elastic rubber rollers. The primary transfer bias can be the same for all 3 colors or may be varied in stages subsequently. At the secondary transfer position of intermediate transfer belt 10, a secondary transfer roller 21 composed of a conductive elastic rubber roller is arranged oppositely to apply +1.2 kV secondary transfer bias behind transfer belt 20. Primary transfer rollers 17Y, 17M and 17C and a secondary transfer roller 21 comprise a secondary transfer means. Further, at the transfer position of photosensitive drum 12BK for black color that is the first image carrier, a direct transfer roller 28 that is a conductive elastic rubber roller and a first transfer means to apply +1.0 kV transfer bias is arranged oppositely behind transfer belt 20.

Color photosensitive drums 12Y, 12M and 12C are rotated in the arrow direction s and black photosensitive drum 12BK is rotated in the arrow direction t. Around color photosensitive drums 12Y, 12M and 12C, there are main chargers 13Y, 13M and 13C, exposure units 14Y, 14M and 14C, color developing units 16Y, 16M and 16C to perform the cleaning simultaneously with developing, primary transfer rollers 17Y, 17M and 17C, charge eliminating lamps 22Y, 22M and 22C, and image disturbing brushes 23Y, 23M and 23C along the rotating direction of the photosensitive drums. Around black photosensitive drum 12BK, there are a main charger 13BK, an exposure unit 14BK, a black developing unit 16BK for performing the cleaning simultaneously with the developing, a direct transfer roller 28, a charge eliminating lamp 22k and an image distributing brush 23BK are arranged.

In this embodiment, black developing unit 16BK is used also acts as a cleaning device to recover toner adhered on intermediate transfer belt 10 and transfer belt 20. Color photosensitive drums 12Y, 12M and 12C are 30 mm in diameter and black photosensitive drum 12BK is 45 mm in diameter. As developing units 16Y, 16C and 16BK are of developing and cleaning type, no photosensitive drum cleaning device such as blade, etc is required.

Main chargers 13Y, 13M, 13C and 13BK can be corona charger (charger wire, comb shape charger, Scorotron charger, etc.), contact charging roller, non-contact charging roller or solid charger. For example, using a contact charging roller, the whole surfaces of photosensitive drums 12Y, 12M, 12C and 12Bk are charged uniformly to −600V+1.5 kV PP.2 kHz. Exposure devices 14Y, 14M, 14C and 14BK form electrostatic latent images on photosensitive drums 12Y, 12M, 12C and 12BK by exposing each color using such known exposing means as a laser optical unit, LED, etc.

In the reverse developing process to supply toner to the exposure units, developing units 16Y, 16M, 16C and 16BK form toner images by supplying toners to the exposure unit that is an image unit of electrostatic latent images formed by new exposure and on the other hand, recovers toners left in the non-exposure unit of electrostatic latent image formed by the new exposure after the transfer of a preceding toner image in the developing devices.

Color developing devices 16Y, 16M and 16C stores two-component color developing agents and black developing device stores two-component black developer and −400V is applied to developing rollers 26Y, 26M, 26C and 26BK as developing bias.

For yellow (Y), magenta (M) and cyan (C) and black (BK) two-component color developing agents, spherical toner particles obtained by the suffusing process of pulverized toner in mean volume diameter 6.0 um of polyester base resin in 90 weight %, pigment in 7 weight % and rice wax in 3 weight % kneaded, pulverized, classified and added with silica, CCA, and titanium oxide particles are used. Further, molecular weight distribution of used resin has one sharp peak. Further, toners may be obtained according to such publicly known chemical processes as suspension polymerization process, emulsion polymerization/condensation process.

The glass transition point of spherical toner particles is 64° C. and the softening point Ti is 84° C. Two-component developer was prepared by mixing and stirring such spherical toner particles with magnetic carrier of ferrite particles of which surface are coated with silicon resin in mean volume particle size 40 μm at a toner content rate of 7 weight %.

Figure 2:
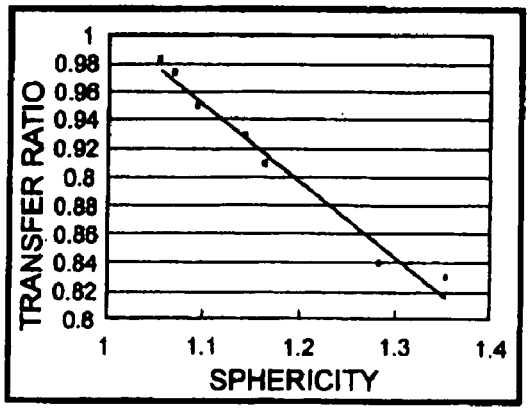
FIG. 2 is a graph showing the general relationship of sphericity and transfer ratio of toner that is used in a first embodiment of this invention.

Spherical toner that is recognized as having a spherical shape according to sphericity expressed by a ratio of stokes diameter (De) of toner/equivalent volume diameter (Ds) satisfying the relationship of $De/Ds \leqq 1.2$ and other systems specifying publicly known such as that disclosed in the Japanese Patent No. 1993-303233 is denoted. Spherical toner is obtained according to such chemical processes as emulsion polymerization, association, suspension polymerization, fusion granulation process, etc., glove-shaping process by heating and friction of pulverized toners. As shown in FIG. 2, the more the sphericity of the toner comes close to 1, the more the transfer efficiency is improved. For example, when a suspension polymerized toner of sphericity 1.07 was used, experimental results that the transfer efficiency from a color toner photosensitive drum to an intermediate transfer belt was 98.5%, the transfer efficiency from an intermediate transfer belt to a recording medium was 95% and the transfer efficiency from a black (BK) tone photosensitive drum was 97% were obtained.

Therefore, when spherical toner is used as toner constituents of two-component developer that are used for developing devices 16Y, 16M, 16C and 16BK, the transfer efficiency is extremely high and toner left on the surfaces of photosensitive drums 12Y, 12M, 12C and 12BK after completing the primary transfer are less. Thus, it becomes possible to recover residual toner sufficiently by the simultaneous cleaning with the development of developing units 16Y, 16M 16C and 16BK without providing photosensitive drum cleaning devices.

Further, when toner images are formed using developing and simultaneous cleaning type developing units, if amounts of toner left on the photosensitive drums after completing the primary transfer, residual toner may intercept the next exposing light, producing image memory for improper exposure and causing defective images.

Image disturbing brushes 23Y, 23M, 23C and 23BK are conductive fiber made brushes of contact resistance $1\times10^7\ \Omega$ with photosensitive drums 12Y, 12M, 12C and 12BK. When +300V is applied to image disturbing brushes 23Y, 23M, 23C and 23BK and the surfaces of photosensitive drums 12Y, 12M, 12C and 12BK are lightly rubbed by the brushes, residual toner loses the image structure left on photosensitive drums 12Y, 12M, 12C and 12BK and the cleaning effect by developing units 16Y, 16M, 16C and 16BK is improved. At the downstream in the sheet paper P conveying direction of transfer belt 20, a fixing unit 27 and a paper discharge tray 30 are arranged.

Next, the operations will be described. In the case of a color image forming process, when the process starts, color image information is input from a scanner, PC terminal, etc. into a printer 8 and color photosensitive drums 12Y, 12M and 12C are rotated in the arrow direction s and black photosensitive drum 12BK is rotated in the arrow direction t. At the same time, transfer belt 20 is rotated in the arrow direction q and intermediate transfer belt 10 is turned in the arrow direction r.

Further, pick-up roller 7*a* is driven and takes out a sheet paper P from paper supply cassette 7. Thereafter, the sheet paper P is kept in the standby state by an aligning roller 7*b*. When the standby of the sheet paper P is confirmed by a sheet paper detecting switch (not shown) provided in aligning roller 7*b*, the color toner images are formed on color photosensitive drums 12Y, 12M, 12C and 12BK by color image forming unit 100 and black image forming unit 110, respectively. Thus, respective image forming processes are started after confirming that a sheet paper P is taken out surely from paper supply cassette and therefore, the wasteful image forming operation at the time of jamming of sheet paper P and waste operation of recovery of much toner can be saved.

When the image forming process starts, photosensitive drums 12Y, 12M, 12C and 12BK are uniformly charged to −600V by main chargers 13Y, 13M, 13C and 13BK. Then, exposing beams corresponding to respective color data are applied to photosensitive drums 12Y, 12M, 12C and 12BK by exposure units 14Y, 14M, 14C and 14BK and electrostatic latent images are formed, respectively. Then, toners are supplied to the exposure units of photosensitive drums 12Y, 12M, 12C and 12Bk by the reverse developing process of developing rollers 26Y, 26M, 26C and 26BK applied with about −400V developing bias, toner adhered to the non exposure portions is recovered and respective toner images are formed on photosensitive drums 12Y, 12M and 12C.

After toner images are formed, in color image forming unit 100, color toner images on color photosensitive drums 12Y, 12M and 12C are transferred primarily in order on the same positions of intermediate transfer belt 10 that is rotating in the allow direction r by primary transfer rollers 17Y, 17M and 17C to which +300V primary transfer bias is applied and three color toner images of yellow (Y), magenta (M) and cyan (C) are superposed each other. Then, intermediate transfer belt 10 transfers the superposed 3 color toner images in a lump secondarily on the sheet paper P conveyed to the secondary transfer position by transfer belt 20 at the position opposite to a secondary transfer roller 21 to which secondary transfer bias of +1.2 kV.

Then, when the sheet P on transfer belt 20 reaches the transfer position of black photosensitive drum 12BK, the black toner image on black photosensitive drum 12BK is directly transferred over the superposed 3 color toner images on the sheet paper P. Thereafter, the sheet paper P having a full-color toner image of superposed yellow (Y), magenta (M), cyan (C) and black (BK) is fixed in fixing unit 27 and conveyed in the direction of paper discharging tray 30.

As described above, yellow (Y), magenta (M) and cyan (C) color toner images are transferred according to the indirect transfer system and a black toner image is transferred according to the direct transfer system and therefore, when a full-color image is formed, it is possible to show a black line edge more clearly and maintain color images of high quality for the throughout of whole life from the initial stage without changing reproducibility of respective colors.

On the other hand, after toner images are transferred on intermediate transfer belt 10 or a sheet paper, image memories for residual toners left on photosensitive drums 12Y, 12M, 12C and 12BK are erased by charge elimination lamps 22Y, 22M, 22C and 22BK. Then, photosensitive drums 12Y, 12M, 12C and 12BK are brought in contact with image disturbing brush 23Y, 23M, 23C and 23BK to which +300V voltage is applied and the image structure of residual toner is disturbed and charges are regulated.

The next charging process and the exposure process are carried out with photosensitive drums 12Y, 12M, 12C and 12BK kept in the state wherein the image structure was disturbed and charge adjusted residual toner is adhered. On photosensitive drums 12Y, 12M, 12C and 12BK, new electrostatic latent images are formed through the next charging process and exposing process and reach developing units 16Y, 16M, 16C and 16BK. Developing units 16Y, 16M, 16C and 16BK develop toner images by supplying toner to the exposing portions of new electrostatic latent images on photosensitive drums 12Y, 12M, 12C and 12BK and at the same time, recover residual toner left on the non-exposing portions of preceding toner images in developing units 16Y, 16M, 16C and 16BK and perform the developing and cleaning. At this time, residual toner left on photosensitive drums 12Y, 12M, 12C and 12BK is disturbed and image structure is lost and charges applied to them are adjusted to easily recoverable level and therefore, developing units 16Y, 16M, 16C and 16BK are satisfactorily cleaned.

Further, residual toner recovered in developing units 16Y, 16M, 16C and 16BK is reused as it is and toner consumption efficiency is improved. For example, the transfer efficiency of black toner to sheet paper P is 93% and when a life test at a print ratio was conducted using an image forming apparatus which discards recovered residual toner without reusing them, a toner consumption per 1000 sheets was 30 g and a toner discharged amount was 6.5 g. On the other hand, when printer 8 in this embodiment adopting developing and cleaning type developing units 16Y, 16M, 16C and 16BK was used, the toner consumption per 1000 sheets was 24 g and it became possible to further reduce toner consumption and at the same time, make a recovery toner box unnecessary.

Then, after the specified image forming process is completed, toners adhered to transfer belt 10 or dropped toners or scattered toners adhered onto transfer belt 20 when color toner images are secondarily transferred to sheet paper P from intermediate transfer belt 10 and further, test patter toners directly printed on transfer belt 20 are recovered by black developing unit 16BK. That is, when transfer belt 20 does not convey sheet paper P after completing the image forming process, according to the steps (S1) to (S4) shown in the explanatory diagram in FIG. 3, adhered toners (S1) on intermediate transfer belt 10 is transferred on transfer belt 20 (S2), further adhered toners on transfer belt 20 are reverse transferred (S3) on black photosensitive drum 12BK and recovered by black developing unit 16BK (S4).

The toner adhered on intermediate transfer belt 10 is transferred on transfer belt 20 using secondary transfer roller 21 that is also used as an adhered toner transfer means. A transfer bias value for secondary transfer roller 21 when the adhered toner on intermediate transfer belt 10 to transfer belt 20 can be the same as a transfer bias value normally for transferring color toner images on intermediate transfer belt 10 on a sheet paper P or different if it is within a range wherein a good transfer can be obtained.

The toners adhered on transfer belt 20 are reverse transferred on black photosensitive drum 12BK using a direct transfer roller 28 that is also used as an adhered toner transfer means. For example, when the charged potential of black photosensitive drum 12BK is −500V, potential after exposure is −400V to −100V and adhered toner is minus charged, the adhered toner on transfer belt 20 is reverse transferred toward black photosensitive drum 12BK when a transfer bias value to direct transfer roller 28 is made to below −500V. The reverse transferred adhered toner on black photosensitive drum 12BK is recovered by black developing unit 16BK. As a result, all toners generated on intermediate transfer belt 10 and transfer belt 20 and to be removed can be recovered in lump at black developing unit 16BK.

On the other hand, when the monochromatic image forming process is started, monochromatic image data is input to printer 8 from a scanner, a PC terminal, etc. and in the same manner as described above, a toner image is formed on a sheet paper P. However, color image forming unit 100 of printer 8 does not operate at this time and black image forming unit 110 only operates. After forming a black toner image on black photosensitive drum 16BK by black image forming unit 110, the black toner image is transferred on a sheet paper P on transfer belt 20 and a monochromatic image is completed on the sheet paper P by fixing with fixing unit 27. Further, at the time of this operation, the toner adhered on transfer unit 20 is recovered by black developing unit 16BK in the same manner as in the steps (S3) and (S4) shown in FIG. 3.

Next, the restoration when the image forming process was interrupted by the jamming of sheet paper P while the image forming process is repeated as described above will be described. When the jamming of sheet paper P is detected the image forming process is immediately stopped (S10) following the steps (S10) to (S16) in the explanatory diagram shown in FIG. 4. With the suspension of the image forming process, a user is urged to remove the sheet paper P and the jam restoration operation starts.

First, developing units 16Y, 16M, 16C and 16BK are so controlled by a controller (not shown) (S11) that toner is not supplied to undeveloped electrostatic latent images on photosensitive drums 12Y, 12M, 12C and 12BK. For example, the developing bias of developing rollers 26Y, 26M, 26C and 26BK are controlled to below the potential of the exposing portions of the electrostatic latent images. Or developing rollers 26Y, 26M, 26C and 26BK are put in the state not contacting with photosensitive drums 12Y, 12M, 12C and 12BK (S12). Definitely, developing agents on developing rollers 26Y, 26M, 26C and 26BK are recovered in the developing units or developing units 16Y, 16M, 16C and 16BK are moved to separate them. The transfer of already developed toner on photosensitive drums 12Y, 12M, 12C and 12BK to transfer to transfer belt 20 is prevented (S13). When photosensitive drums 12Y, 12M, 12C and 12BK are rotated and developed toner arrives at the primary transfer positions, primary transfer rollers 17Y, 17M and 17C or direct transfer roller 28 are controlled by the controller (not shown).

For example, transfer bias values of primary transfer rollers 17Y, 17M, 17C or direct transfer roller 28 are so controlled so that the electric field applied to the toner is directed toward the reverse direction to the normal transferring time. Definitely, while the transfer bias value of primary transfer rollers 17Y, 17M and 17C are +300V or the transfer bias value of direct transfer roller 28 is +1.0 kV at the time of normal transfer, the transfer bias value of primary transfer rollers 17Y, 17M and 17C is controlled to −300 to −500V and the transfer bias value of direct transfer roller 28 is controlled to 0 to −500V at the time when the operation is restored from the interruption for the paper jamming. Or the transfer nip of primary transfer rollers 17Y, 17M, 17C or direct transfer roller 28 are separated (S14).

As a result, the toner images on photosensitive drums 12Y, 12M, 12C or 12BK passed the transfer position without transferred on intermediate transfer belt 10 or a sheet paper P pass through the charging area as it is and toner is recovered in developing units 16Y, 16M, 16C and 16BK (S16). At this time, developing units 16Y, 16M, 16C and 16BK are returned to the state at the time of normal development. Further, after pass the transfer positions, the image structure may be disturbed by image disturbing brushes 23Y, 23M, 23C and 23Bk and charge can be adjusted (S15).

A time to return to the state at the time of normal development in the step (S16) after developing units 16Y, 16M, 16C and 16BK are put to the state not to develop images in the step (S12) described above is more than a time when photosensitive drums 12Y, 12M, 12C and 12BK are rotated to the developing positions from the exposure positions and a timing to be restored to the state at the time of normal development is faster than at least a time for photosensitive drums 12Y, 12M, 12C and 12BK to rotate from the transfer positions to reach the developing positions. However, when amount of developing toner on photosensitive drums 12Y, 12M, 12C and 12BK are voluminous and cannot be recovered fully by developing units 16Y, 16M, 16C and 16BK in one time pass of the developing area, photosensitive drums 12Y, 12M, 12C and 12BK may be rotated in plural times to fully recover the toner.

Next, the recovery of toner adhered to intermediate transfer belt 10 or transfer belt 20 when the image forming process was interrupted for the jam of sheet paper P will be described. After stopping the image forming process by the jam of sheet paper P detected, the image forming process is topped (S10) following the steps (S10) to (S24) in the explanatory diagram shown in FIG. 5 in the same manner as in the steps (S2) to (S4) in the normal image forming shown in FIG. 3, toners adhered on intermediate transfer belt 10 are transferred to transfer belt 20 (S21), the adhered toner on transfer belt 20 is reverse transferred on black photosensitive drum 12BK (S22) and recovered in black developing unit 16BK (S24).

After completing the removal of sheet paper P, recovery of toners on photosensitive drums 12Y, 12M, 12C and 12BK and the recovery of toner on intermediate transfer belt 10 and transfer belt 20, printer 8 is restored.

According to this first embodiment, in a tandem type color image forming apparatus, when a color image forming unit 100 to form color images using color developing units 16Y, 16M and 16C for developing and cleaning and a monochromatic image forming unit 110 to form monochromatic images using black developing unit 16BK for developing and simultaneously cleaning are provided respectively, color image forming unit 100 can be stopped when a monochromatic image is formed and it becomes possible to prevent deterioration of various consumables of color image forming unit 100 and extend its life.

Furthermore, while color image forming unit 100 adopts an intermediate transfer system to superpose color images on intermediate transfer belt 10, black image forming unit 110 adopts a direct transfer system to transfer monochromatic images directly on sheet paper P. Accordingly, when forming a full-color image, a color image in high quality of uniform color reproducibility can be obtained by maintaining transfer efficiency at a constant level using intermediate transfer belt 10 without being affected by environmental variations such as material of sheet paper P. On the other hand, as a black toner image is directly transferred on a sheet paper P from black photosensitive drum 12BK, black lines of clear edges are obtained and full-color images and monochromatic images of high quality can be obtained. Further, a black toner image is obtained by one time transfer and its scattering amount can be reduced.

Further, as developing units 16Y, 16M, 16C and 16BK are adopting the developing and simultaneous cleaning system, a recovered toner box is no longer required and contribute to the downsizing of the apparatus. Further, developing units 16Y, 16M, 16C and 16BK recycle recovered toner for use and the consumption of toner can be reduced.

Furthermore, toner transferred on intermediate transfer belt 10 or transfer belt 20 from color image forming unit 100 and monochromatic image forming unit 110 can be recovered in black developing unit 16BK. Accordingly, it is solely not necessary to provide a toner recovery box, an apparatus can be downsized, recovered toner can be recycled for use and toner consumption can be further reduced.

Further, in the restoring operation after the jamming of sheet paper P, the development is not made in the unfixing areas on photosensitive drums 12Y, 12M, 12C and 12BK, and in the already developed portions, color toner is recovered in developing units 16Y, 16M, 16C and 16BK, respectively. Thus, recovery of unnecessarily much toner in black developing unit 16BK can be prevented and deterioration of black color of developer in black developing unit 16BK can be prevented.

Figure 6:
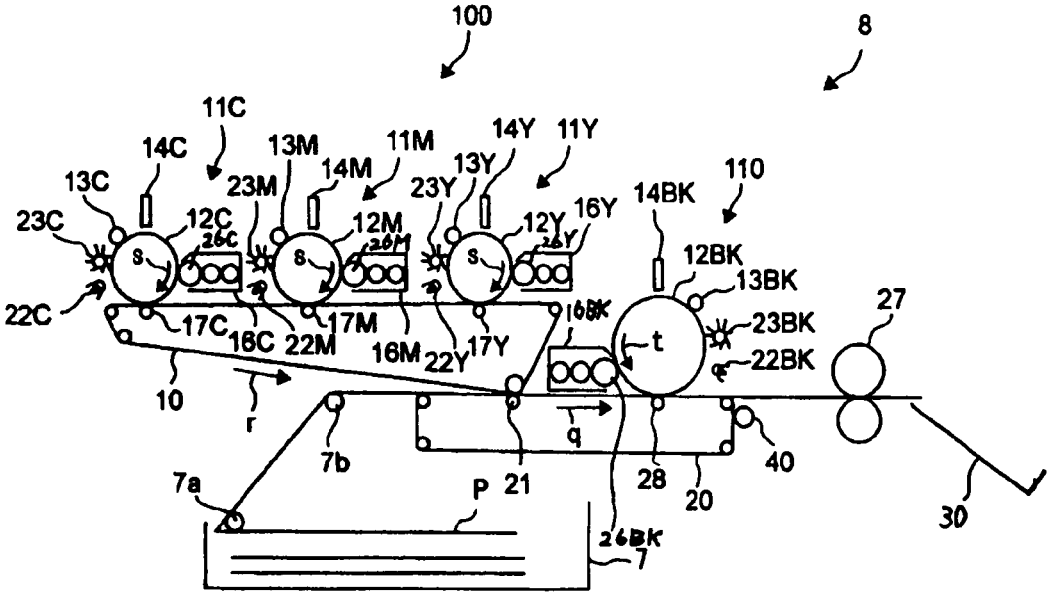
FIG. 6 is a schematic construction diagram showing a printer in the second embodiment of this invention.

Next, a second embodiment of this invention will be described. This second embodiment differs from the first embodiment in the adhered toner recovery method. Accordingly, in this second embodiment, the same reference numeral will be assigned to the same portion as the structure explained in the first embodiment and the detailed explanation thereof will be omitted. In this embodiment, a transfer belt cleaner 40 is provided as a conveying/cleaning means at the downstream in the conveying direction from the transfer position of black image forming unit 110 of transfer belt 20 as shown in FIG. 6.

Transfer belt cleaner 40 recovers all adhered toner originated from color toners transferred from color image forming unit 100 and black toner transferred from black image forming unit 110 instead of black image unit 16BK in the first embodiment. Transfer belt cleaner 40 is composed of publicly known cleaners such as a rubber made cleaning blade, a rotary brush cleaner applied with voltage, etc.

Figure 3:
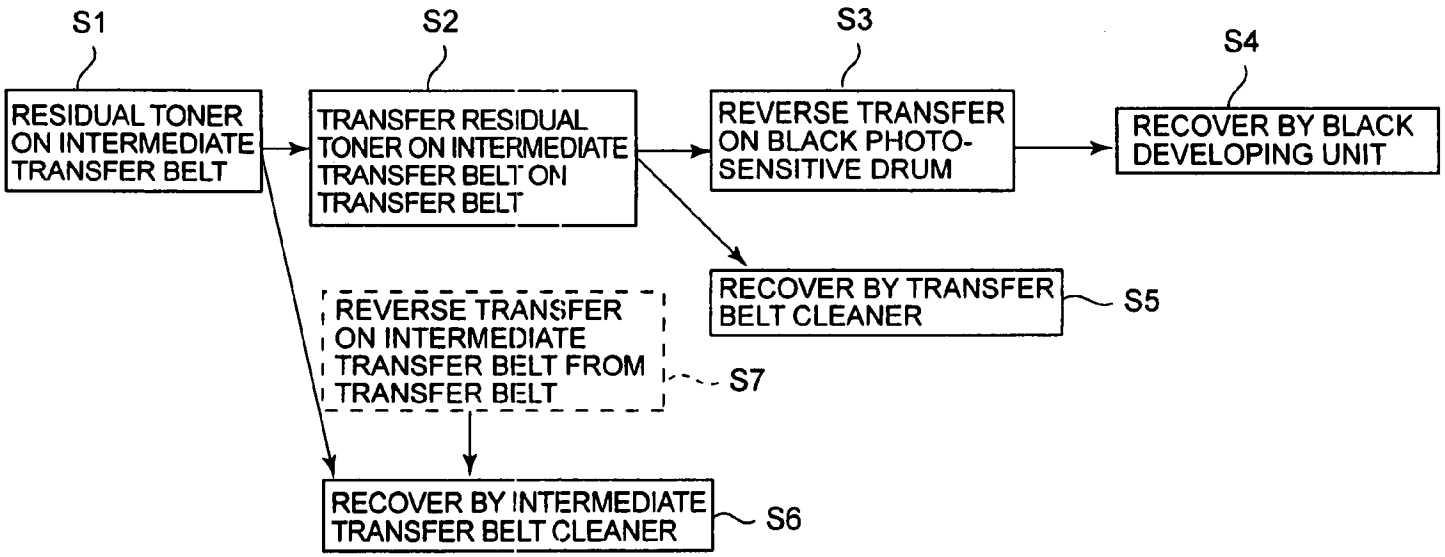
FIG. 3 is an explanatory diagram showing the recovery of adhered toner after completion of the image forming process in the first through third embodiment of this invention.

In this second embodiment, after completing a specified image forming process, adhered toner (S1) on intermediate transfer belt 10 is transferred on transfer belt 20 (S2) in the same manner as in the first embodiment according to the explanatory diagram in FIG. 3. Thereafter, toner adhered on transfer belt 20 passes the black photosensitive drum 12BK position as it is without being transferred to black photosensitive drum 12BK and all of it is recovered by transfer belt cleaner 40 provided on the transfer belt (S5). The adhered toner recovered by transfer belt cleaner 40 is accumulated in a recovered toner box (not shown) and discharged. Thus, all toner generated on intermediate transfer belt 10 and transfer belt 20 to be removed can be recovered in lump by transfer belt cleaner 40. The adhered toner recovered in the recovery toner box can be recycled for use.

Figure 4:
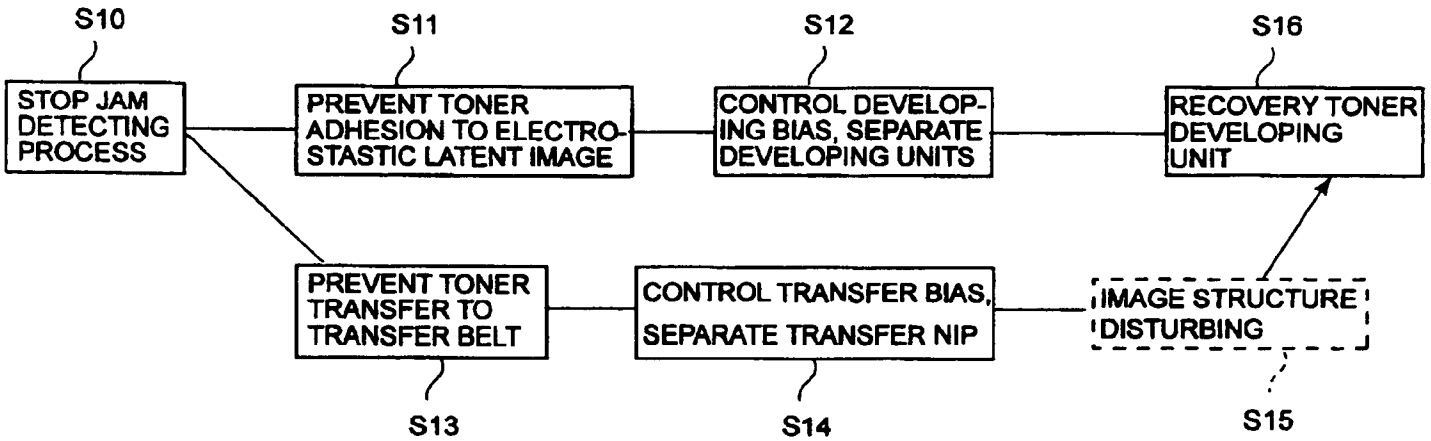
FIG. 4 is an explanatory diagram showing the recovery of toner on a photosensitive drum at the time of restored when the image forming process was interrupted of the first embodiment of this invention.
Figure 5:
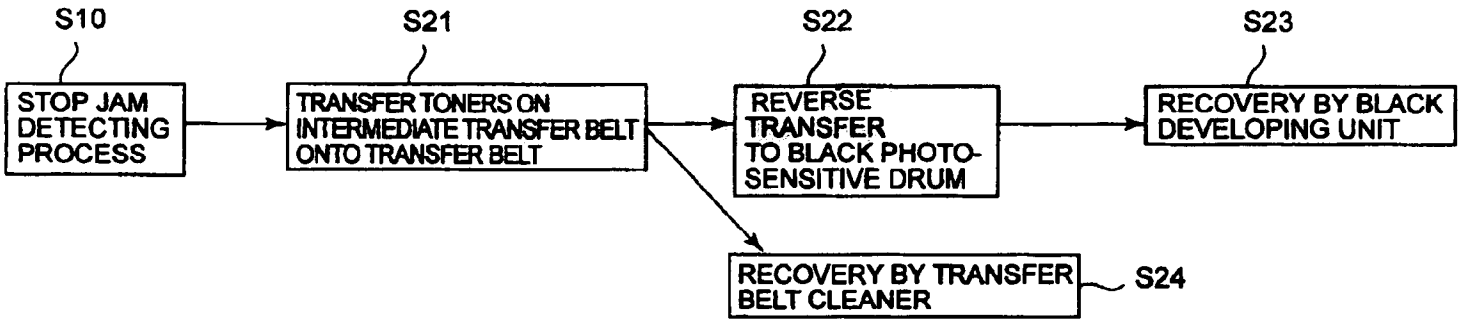
FIG. 5 is an explanatory diagram showing the recovery of adhered toner when the image forming process was interrupted and restored in the first and second embodiments of this invention.

Next, the recovery of toner adhered on intermediate transfer belt 10 or transfer belt 20 when the image forming process was interrupted for the jam of sheet paper P will be described. When a sheet paper is jammed, the image forming process is stopped (S10) in the same manner as in the first embodiment described above according to the explanatory diagram shown in FIG. 4. Already developed toner on photosensitive drums 12Y, 12M, 12C and 12BK is recovered by developing units 16Y, 16M, 16C and 16BK so that toner is not adhered on electrostatic latent images that are undeveloped on photosensitive drums 12Y, 12M, 12C and 12BK. Further, adhered toner on intermediate transfer belt 10 is transferred on transfer belt 20 (S21) as shown in FIG. 5. Then, adhered toner on transfer belt 20 is all recovered by transfer belt cleaner 40 (S24). The adhered toner recovered by transfer belt cleaner 40 is accumulated in the recovered toner box and discharged. The recovered adhered toner is recycled for use.

According to this second embodiment, in a tandem type color image forming apparatus, it is possible to save toner consumption, monochromatic images and color images in satisfactory quality can be formed and life times of various consumables can be extended. Furthermore, adhered toner on intermediate transfer belt 10 or transfer belt 20 transferred from color image forming unit 100 and black developing unit 110 can be recovered at one point by transfer belt cleaner 40. Accordingly, when the recovered toner can be easily recycled for use and further, one recovered toner box is sufficient and an apparatus can be downsized. Further, intermediate transfer belt 10 is not subject to abrasion by the cleaner when recovering adhered toner and its life time can be extended.

Figure 7:
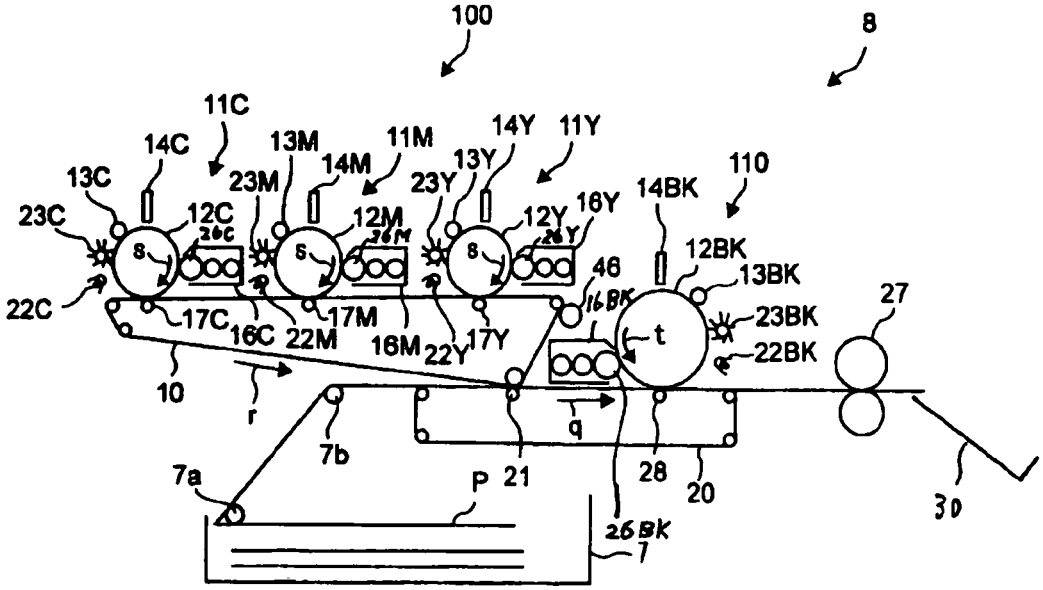
FIG. 7 is a schematic construction diagram showing a printer in the third embodiment of this invention.

Next a third embodiment of this invention will be explained. This third embodiment differs in that the adhered toner recovery method differs from that in the first embodiment. Accordingly, in this third embodiment, the same components as those in the first embodiment will be assigned with the same reference numerals and the detailed explanation thereof will be omitted. In this embodiment, an intermediate transfer belt cleaner 46 is provided, which is an intermediate transfer belt cleaner to remove adhered toner on intermediate transfer belt 10 after passing the secondary transfer position as shown in FIG. 7.

Intermediate transfer belt cleaner 46 recovers all toner adhered on intermediate transfer belt 10 and transfer belt 20 for black developing unit 16BK in the first embodiment. Intermediate transfer belt cleaner 46 is composed of such publicly known cleaners as a rubber made cleaning blade, rotary brush cleaner with voltage applied.

In this third embodiment, after completing the specified image forming process, toner (S1) adhered on intermediate transfer belt 10 is recovered (S6) by intermediate transfer belt cleaner 46 as shown in FIG. 3. Toner adhered when a color toner image is secondarily transferred on a sheet paper P from intermediate transfer belt 10 or toner dropped or scattered on transfer belt 20 and further, test pattern toner directly printed on transfer belt 20 passes black photosensitive drum 12BK position as it is and reach the secondary transfer position. Toner adhered on transfer belt 20 is reverse transferred (S7) on intermediate transfer belt 10 as voltage is applied to secondary transfer roller 21.

At this time, transfer bias is applied to secondary transfer roller 21 to form the electric field in the direction of intermediate transfer belt 10 from transfer belt 20 at the contact portion with intermediate transfer belt 10. For example, when charged potential on photosensitive drums 12Y, 12M, 12C and 12BK forming toner images was −500V, potential after exposure was −400V to −100V and the toner was minus charged, transfer bias value for reverse transferring adhered toner on transfer belt 20 to intermediate transfer belt 10 is set at equivalent to or lower than −500V. In this way, toner adhered on intermediate transfer belt 10 is not transferred on transfer belt 20. Further, the adhered toner on transfer belt 20 is reverse transferred on intermediate transfer belt 10. Adhered toner on intermediate transfer belt 10 including adhered toners reverse transferred from transfer belt 20 is all recovered by intermediate transfer belt cleaner 46 (S6). The adhered toner recovered by intermediate transfer belt cleaner 46 is accumulated in and discharged from a recovery toner box (not shown). Thus, it becomes possible to recover all toner adhered on intermediate transfer belt 10 and transfer belt 20 to be removed in lump by intermediate transfer belt cleaner 46. The recovered adhered toner are recycled for use.

Next, the recovery of toner adhered on intermediate transfer belt 10 or transfer belt 20 when the image forming process was interrupted by the jam of a sheet paper P will be described. When a sheet paper P was jammed, the image forming process is stopped (S10) as shown in FIG. 4 likewise the first embodiment described above. On photosensitive drums 12Y, 12M, 12C and 12BK, the further development is not allowed and already developed toners on photosensitive drums 12Y, 12M, 12C and 12BK is recovered in developing units 16Y, 16M, 16C and 16BK.

Figure 8:
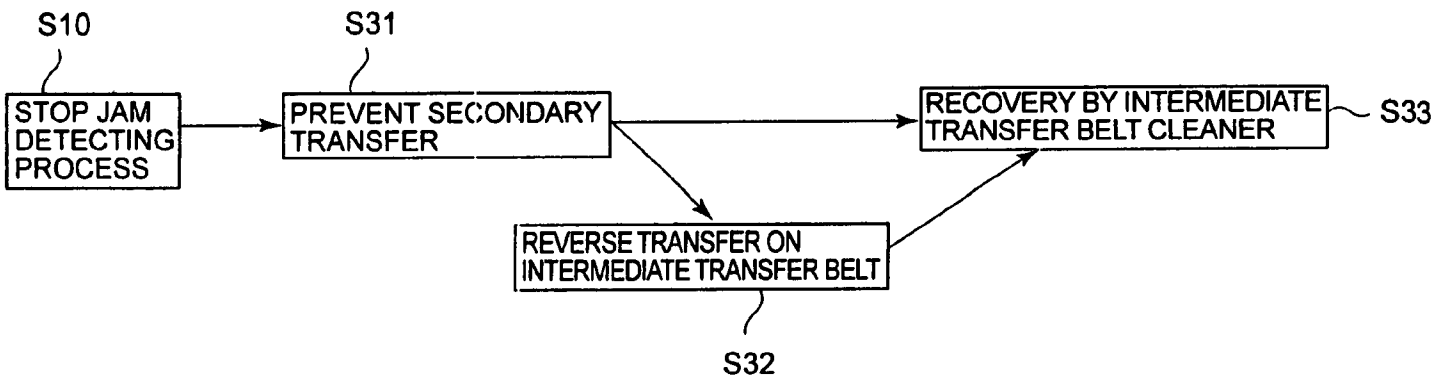
FIG. 8 is an explanatory diagram showing the recovery of adhered toner when the image forming process was interrupted and restored in the third embodiment of this invention.

On the other hand, on intermediate transfer belt 10, a toner image primarily transferred on intermediate transfer belt 10 is prevented (S31) from being secondarily transferred on transfer belt 20 as shown in FIG. 8. For example, potential equivalent to the potential at the time of the reverse transfer described above may be applied to secondary transfer roller 21 or the transfer nip of the secondary transfer position may be separated so that a toner image is not secondarily transferred on transfer belt 20. Therefore, intermediate transfer belt 10 with toner adhered thereon passes the secondary transfer position without transferring toner on transfer belt 20 and then, the adhered toner is removed and recovered by intermediate transfer belt cleaner 46. Thereafter, when the transfer nip is separated at the secondary transfer position, it is brought in contact with the secondary transfer position again and the toner adhered on sheet transfer belt 20 is reverse transferred on intermediate transfer belt 10 by applying the potential equivalent to that at the time of reverse transfer described above to the secondary transfer roller 21 (S32). The adhered toner on intermediate transfer belt 10 including the adhered toner reverse transferred from transfer belt 20 is all recovered by intermediate transfer belt cleaner 46 (S33). The adhered toner recovered by intermediate transfer belt cleaner 46 is accumulated in the recovery toner box (not shown) and discharged therefrom. Thus, all toner that is generated on intermediate transfer belt 10 and transfer belt 20 to be removed can be recovered in a lump by intermediate transfer belt cleaner 46. The recovered adhered toner are recycled for reuse.

According to this third embodiment, in a tandem type color image forming apparatus, it is possible to save toner consumption, satisfy both monochromatic and color image quality and extend life times of various consumables likewise the first embodiment. Furthermore, it is possible to recover adhered toner on intermediate transfer belt 10 or transfer belt 20 transferred from color image forming unit 100 and black developing unit 110 at one point by intermediate transfer belt cleaner 46. Accordingly, only one adhered toner recovery box is sufficient and thus, an apparatus can be downsized and transfer belt 20 is not subject to abrasion by the transfer belt cleaner in the adhered toner recovery and its life can be extended.

Further, this invention is not restricted to the embodiments described above but can be modified variously in the scope thereof. For example, when a color image forming apparatus is of tandem type using developing units of developing and simultaneous cleaning type, its arranging structure, number of image forming units and further, colors of developing agents, etc. are not limited. Further, developing agents may not be spherical toner. However, when spherical toner is used, it becomes possible to get a good cleaning performance in the developing and cleaning. Further, materials of the first and second are also not limited, and the volume resistance of the second conveying means can be about $1\times10^{7}$ Ω to $1\times10^{10}$ Ω and the volume resistance of the first conveying means can be about $1\times10^{9}$ Ω to $1\times10^{12}$ Ω. Further, because a toner image is disturbed before the developing and cleaning, such publicly known memory disturbing members as a fixed brush, a laterally sliding brush, a non-woven cloth or charger, etc. may be provided. Further, transfer bias in the primary transfer, the secondary transfer or various reverse transferring are optional.

According to the present invention described above in detail, in a tandem type color image forming apparatus, it is possible to satisfy both the quality of image and the image forming speed demanded for the full-color image forming and monochromatic image forming and furthermore, in the monochromatic image forming, it is not required to drive the color image forming units unnecessarily, deterioration of various kinds of consumables of the color image forming units is prevented thus, extending their life times and frequencies of maintenance are reduced. Further, the toner consumption efficiency is increased by the use of recycled adherence toners, waste toner is eliminated and the resource saving can be achieved.

What is claimed is:

1. A color image forming apparatus for forming color images including a first color toner image and a second color toner image which is differing from the first color, comprising:

first image forming means provided with developing means for performing developing and simultaneous cleaning for an electrostatic latent image formed on a first image carrier to form the first color toner image;

second image forming means provided with developing means for performing developing and simultaneous cleaning for an electrostatic latent image formed on a second image carrier to form the second color toner image;

first transfer means for transferring the first color toner image formed on the first image carrier by the first image forming means onto a recording medium, the first transfer means including a first conveying means for conveying the recording medium to the first image forming means;

second transfer means for transferring the second color toner image formed on the second image carrier by the second image forming means onto the recording medium, the second transfer means including a second conveying means for conveying the second color toner image formed by the second image forming means to the first conveying means; and single cleaning means for recovering toner adhered to the first transfer means and the second transfer means, wherein the cleaning means is the developing means provided to the first image forming means, and wherein second color toner adhered on the second conveying means is transferred to the first conveying means and the second color toner is recovered by the developing means in the first image forming means.

2. The color image forming apparatus as claimed in claim 1, wherein the first image forming means is a black image forming unit to form a black toner image, and the second image forming means is a color image forming unit to form at least one color toner image.

3. The color image forming apparatus as claimed in claim 1, wherein the cleaning means is a cleaning member to clean the first conveying means.

4. A color image forming apparatus to form a full-color image by superposing a black toner image formed by a black image forming unit and a color-toner image formed by a color image forming unit on a recording medium, comprising:

a black developing unit to perform the developing and simultaneous cleaning for an electrostatic latent image formed on a black photosensitive drum;

a color developing unit to perform the developing and simultaneous cleaning for an electrostatic latent image formed on a color photosensitive drum;

a black image transfer unit to transfer the black toner image on the black photosensitive drum onto the recording medium, the black image transfer means includes a transfer belt to convey the recording medium to the transfer position of the black image forming unit;

a color image transfer unit to transfer the color toner image on the color photosensitive drum onto the recording medium, the color image transfer unit including an intermediate transfer belt to convey the color toner image formed by the color image forming unit to the transfer belt; and a single cleaner to recover the black toner adhered to a side transferred from the black image forming unit and the color toner adhered to a side transferred from the color image forming unit. belt.

5. The color image forming apparatus as claimed in claim 4, wherein the cleaner is a transfer belt cleaner to clean the transfer belt.

6. The color image forming apparatus as claimed in claim 5, wherein the color toner adhered on the intermediate transfer belt is adhered on the transfer belt and recovered by the tranfer belt cleaner.

7. The color image forming apparatus as claimed in claim 4, wherein the cleaner is an intermediate transfer belt and the intermediate transfer belt.

8. The color image forming apparatus as claimed in claim 7, wherein the toner adhered on the transfer belt is adhered on the intermediate transfer belt and recovered by the intermediate transfer belt cleaner.

9. A color image forming method to form a color image by superposing a black toner image formed by the black image forming unit and a color toner image formed by a color image forming unit on a recording medium, comprising:

recovering a black toner adhered on the black image carrier by the black developing unit after transferring the black toner image developed from the black image carrier by the black image developing unit;

recovering a color toner adhered on the color image carrier by the color developing unit after transferring a color toner image formed by developing them on the color image carrier by the color developing unit to a recording medium side; and cleaning to recover black toner adhered on a side transferred from the black image forming unit and color toner adhered on a side transferred from the color image forming unit by a single cleaning means, wherein the black toner image is transferred on the recording medium conveyed by a transfer belt and after primarily transferring the color toner image on an intermediate transfer belt, the color image is secondarily transferred on the recording medium conveyed by the transfer belt, and cleaning is carried out using a transfer belt cleaner, and wherein cleaning is carried out by adhering the color toner on the intermediate transfer belt onto the transfer belt.

10. The color image forming method as claimed in claim 9, wherein the black developing unit is also used for cleaning.

* * * * *